US006121854A

United States Patent [19]

Griffith et al.

[11] Patent Number: 6,121,854

[45] Date of Patent: Sep. 19, 2000

[54] REDUCED SIZE 2-WAY RF POWER DIVIDER INCORPORATING A LOW PASS FILTER STRUCTURE

[75] Inventors: Robert K. Griffith; Roland Matian, both of San Jose, Calif.

[73] Assignee: Digital Microwave Corporation, San Jose, Calif.

[21] Appl. No.: 09/295,468

[22] Filed: Apr. 19, 1999

[51] Int. Cl.[7] ..... H01P 5/12

[52] U.S. Cl. ..... 333/128; 333/204

[58] Field of Search ..... 333/127, 128, 333/126, 134, 204

[56] References Cited

U.S. PATENT DOCUMENTS

| | | | |
|---|---|---|---|
| 3,091,743 | 5/1963 | Wilkinson | 333/127 |
| 4,168,479 | 9/1979 | Rubin | 333/126 |
| 4,644,302 | 2/1987 | Harris et al. | 333/125 |
| 4,769,618 | 9/1988 | Parish et al. | 330/277 |
| 4,851,795 | 7/1989 | Beckwith | 333/100 |
| 4,901,042 | 2/1990 | Terakawa et al. | 333/127 |
| 5,150,084 | 9/1992 | Asa et al. | 333/128 |
| 5,705,962 | 1/1998 | Fleeger et al. | 333/136 |

*Primary Examiner*—Paul Gensler

*Attorney, Agent, or Firm*—Skjerven, Morrill, MacPherson, Franklin & Friel LLP; Carmen C. Cook; Edward C. Kwok

[57] ABSTRACT

A power divider includes an input port, a first output port, a second output port, a first transformer coupled between the input port and the first output port, and a second transformer coupled between the input port and the second output port. The first and second transformers each incorporates a low pass filter. The power divider further includes a ground plate disposed adjacent to the first and second transformers. The ground plate is capacitively coupled to the low pass filters of the first and second transformers for enhancing the low pass filtering characteristics of the power divider. The power divider provides low pass filtering capability while achieving a significant size reduction over conventional power dividers.

36 Claims, 5 Drawing Sheets

REDUCED SIZE 2-WAY RF POWER DIVIDER INCORPORATING A LOW PASS FILTER STRUCTURE

BACKGROUND OF THE INVENTION

1. Field of the Invention

The invention generally relates to microwave power dividers and combiners. In particular, the present invention relates to a reduced size 2-way power divider/combiner incorporating a low pass filter structure.

2. Background of the Invention

In a microwave system, a power divider receives a radio frequency (RF) signal or a microwave frequency signal on an input port and equally divides the power among two or more output ports. A desired impedance is maintained at the input port and at each of the two or more output ports.

FIG. 1 illustrates a conventional two-way power divider 10, commonly known as the Wilkinson power divider. Power divider 10 receives a RF signal or a microwave signal at an input port 12. The received signal is equally distributed among transmission line transformers 14 and 15 and outputted on output ports 17 and 18. The impedance, Z1, at each of input port 12 and output ports 17 and 18 is set to a value of 50 ohms, for example. The impedance, Z2, of each of transformers 14 and 15 is given by:

$$Z2=\sqrt{Z1\times 2Z1}.$$

Thus, the impedance Z2 of each of transformers 14 and 15 is 70.7 ohms. Transformers 14 and 15 are each a quarter-wavelength transformer. The length of transformers 14 and 15 is set to be a quarter-wavelength ($\lambda/4$) or an odd integer multiple of $\lambda/4$, where the wavelength $\lambda$ is related to the operation frequency of power divider 10. A termination resistor or isolation resistor 16 is coupled between output ports 17 and 18.

Power divider 10 can also function as a power combiner. When incident microwave signals or RF signals are presented at output ports 17 and 18, the signals feed through transformers 14 and 15 and are combined at input port 12.

Conventional power dividers such as the Wilkinson power divider illustrated in FIG. 1 have several disadvantages. One disadvantage is that conventional power dividers have no frequency rejection property. In some microwave applications, there is a need to filter out high frequency harmonics. For instance, when an oscillator is driving a microwave transmission at 2 GHz, the 2 GHz signal includes undesirable high frequency harmonics at 6 GHz, 8 GHz, and 10 GHz which need to be filtered out for proper circuit operation.

In conventional microwave circuits, a low pass filter is connected in series with the power divider to perform a low pass filtering function of the output signal. However, the series combination of a power divider and a low pass filter greatly increases the size of the microwave circuit. Due to increasing circuit density and complexity, there is a need to reduce the component sizes of microwave circuits. Therefore, the series combination of a power divider and a low pass filter is undesirable for most microwave circuit applications because of component size consideration.

Therefore, there is a need to provide a power divider having low pass filtering capability which is also reduced in size.

SUMMARY OF THE INVENTION

According to one embodiment of the present invention, a power divider/combiner for dividing and combining microwave power includes an input port, a first output port, a second output port, a first transformer coupled between the input port and the first output port, and a second transformer coupled between the input port and the second output port. The first and second transformers each incorporates a low pass filter. The power divider/combiner further includes a ground plate disposed adjacent to the first and second transformers and capacitively coupled to the low pass filters of the first and second transformers.

In an alternate embodiment, the first and second transformers each includes multiple series transmission line elements. The series transmission line elements are connected in series along each of the first and second transformers. Furthermore, the first and second transformers each includes multiple shunt transmission line elements. The shunt transmission line elements extend from the series transmission line elements toward the ground plate. In this configuration, the ground plate is capacitively coupled to the shunt transmission line elements. In another embodiment, the series transmission line elements are high impedance transmission line elements. In yet another embodiment, the shunt transmission line elements are low impedance transmission line elements.

According to another embodiment of the present invention, the ground plate is a floating ground plate. The floating ground plate is capacitively coupled to the shunt transmission line elements of the first and second transformers and serves to enhance the low pass rejection properties of the power divider/combiner. In another embodiment, the ground plate may be electrically connected to the ground potential.

The power divider/combiner may further include an isolation resistor disposed between the first output port and the second output port.

According to another embodiment of the present invention, the series transmission line elements of each of the first and second transformer are of different lengths. The sum of the lengths of the series and shunt transmission line elements of each transformer equals an odd integer multiple of a quarter wavelength.

The power divider/combiner of the present invention provides low pass filtering capability while achieving a significant size reduction over conventional power dividers or combiners. The power divider/combiner can be configured to perform a narrow band low pass filter function. The use of a ground plate to capacitively couple the low pass filter of the power divider/combiner further enhances the low pass filter characteristic of the power divider/combiner.

The present invention is better understood upon consideration of the detailed description below and the accompanying drawings.

BRIEF DESCRIPTION OF THE DRAWINGS

In the present disclosure, like objects which appear in more than one figure are provided with like reference numerals.

DETAILED DESCRIPTION OF THE PREFERRED EMBODIMENTS

Figure 2:
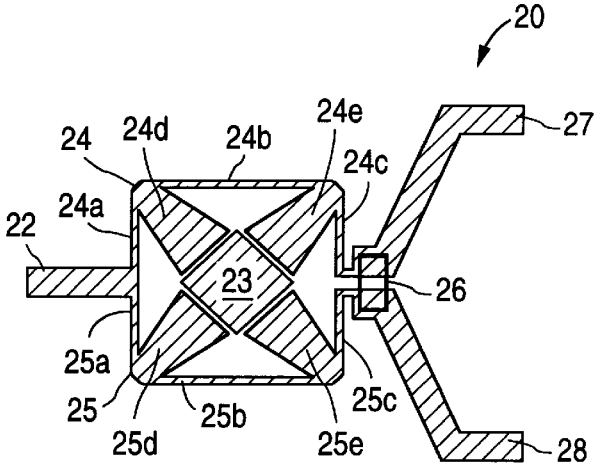
FIG. 2 is a top view of a power divider according to one embodiment of the present invention.

FIG. 2 illustrates a two-way power divider 20 according to one embodiment of the present invention. Power divider 20 incorporates a low pass filter structure and achieves a significant size reduction over conventional power dividers.

Power divider 20 includes an input port 22, a first transformer 24, a second transformer 25, output ports 27 and 28, and an isolation resistor 26. Isolation resistor 26 is a 100 ohms resistor included for enhancing the isolation of output ports 27 and 28. In the present embodiment, first and second transformers 24, 25 are each a quarter-wavelength transformer. Furthermore, the impedance at each of input port 22 and output ports 27, 28 is set at 50 ohms. The 50 ohms impedance used here for power divider 20 is illustrative only. One skilled in the art will appreciate that the impedance of the input and output ports (Z1) can be set to any desirable values and the impedance of the transformers (Z2) is set accordingly by the equation given above.

Power divider 20 acts as a power divider when an input signal is applied to input port 22 and power divider 20 divides the power of the signal for output at output ports 27, 28. Power divider 20 can also act as a power combiner when input signals are applied in the opposite direction to output ports 27, 28 and power divider 20 combines the power of the signals for output at input port 22. In the present description, the term "power divider" is used to refer to the power divider/combiner of the present invention. However, one skilled in the art will appreciate that power divider 20 can both divide and combine microwave powers. In addition, the terms "input port" and "output ports" are used to describe the terminals of power divider 20 functioning as a power divider. One skilled in the art will also appreciate that when power divider 20 is being operated as a power combiner, the functions of the terminals are reversed. In that case, input port 22 acts as the output port and output ports 27, 28 act as input ports.

In power divider 20, first and second transformers 24, 25 each incorporates a low pass filter structure. The low pass filter structure includes multiple filter sections composed of series and shunt transmission line elements. Referring to FIG. 2, first transformer 24 includes series transmission line elements 24*a*, 24*b*, and 24*c*, and shunt transmission line elements 24*d* and 24*e*. Second transformer 25 incorporates an identical low pass filter structure which includes series transmission line elements 25*a*, 25*b*, and 25*c*, and shunt transmission line elements 25*d* and 25*e*. In the present embodiment, series transmission line elements 24*a–c* and 25*a–c* are arranged in a rectangular configuration. Shunt transmission line elements 24*d–e* and 25*d–e* extend from series transmission line elements 24*a–c* and 25*a–c* and have open ends pointed towards the center of the rectangle.

Series transmission line elements 24*a–c* and 25*a–c* are high impedance transmission lines. In the present embodiment, each of series transmission line elements 24*a–c* and 25*a–c* has an impedance of 115 ohms. On the other hand, shunt transmission line elements 24*d–e* and 25*d–e* are low impedance transmission lines and in the present embodiment, shunt transmission line elements 24*d–e* and 25*d–e* each has an impedance in the range of 35 to 40 ohms.

Because first and second transformers 24, 25 are each a quarter-wavelength transformer, the lengths of the series and shunt transmission line elements of each transformer are set such that the sum of the lengths of all the transmission line elements equals $\lambda/4$ (or $0.25\lambda$). As mentioned above, wavelength $\lambda$ is related to the operation frequency of power divider 20. With respect to first transformer 24, the lengths of series transmission line elements 24*a* and 24*c* are $0.04\lambda$ each and the length of series transmission line element 24*b* is $0.08\lambda$. Thus, the total length of the series transmission lines is $0.16\lambda$. The shunt transmission line elements 24*d–e* each has a length of $0.04\lambda$, yield a total length of $0.08\lambda$. Thus, the total length of first transformer 24 is $(0.16\lambda+0.08\lambda)$ which is $0.24\lambda$, sufficiently approximating a quarter-wavelength.

Second transformer 25 has an identical low pass filter structure as first transformer 24. Series transmission line elements 25*a*, 25*b*, and 25*c* have lengths of $0.04\lambda$, $0.08\lambda$ and $0.04\lambda$ respectively. Shunt transmission line elements 25*d–e* each has a length of $0.04\lambda$. Thus, the total length of second transformer 25 is the same as first transformer 24 and equals $0.24\lambda$, approximating a quarter-wavelength.

Power divider 20 can be constructed as a printed structure on a printed circuit board. Any suitable microwave laminate material may be used. For example, Rogers™ 4003 copper clad laminate is one suitable material. When power divider 20 is constructed as a printed structure, isolation resistor 26 is added as an discrete component and any suitable resistor can be used. Power divider 20 can also be constructed as a microwave monolithic integrated circuit (MMIC), for example, on a GaAs substrate. When constructed as a MMIC device, isolation resistor 26 can be constructed as an integrated thin film resistor.

Figure 4:
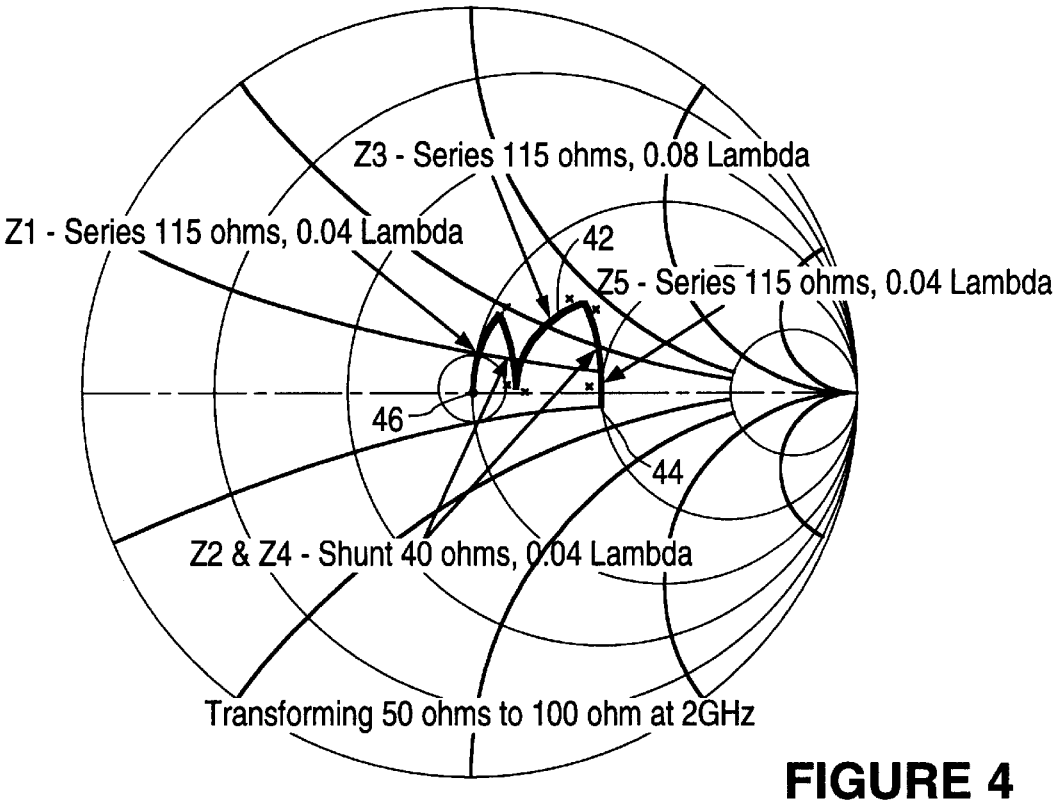
FIG. 4 is a Smith Chart illustrating the impedance transformation along the first or second transformer of the power divider of FIG. 2.
Figure 5:
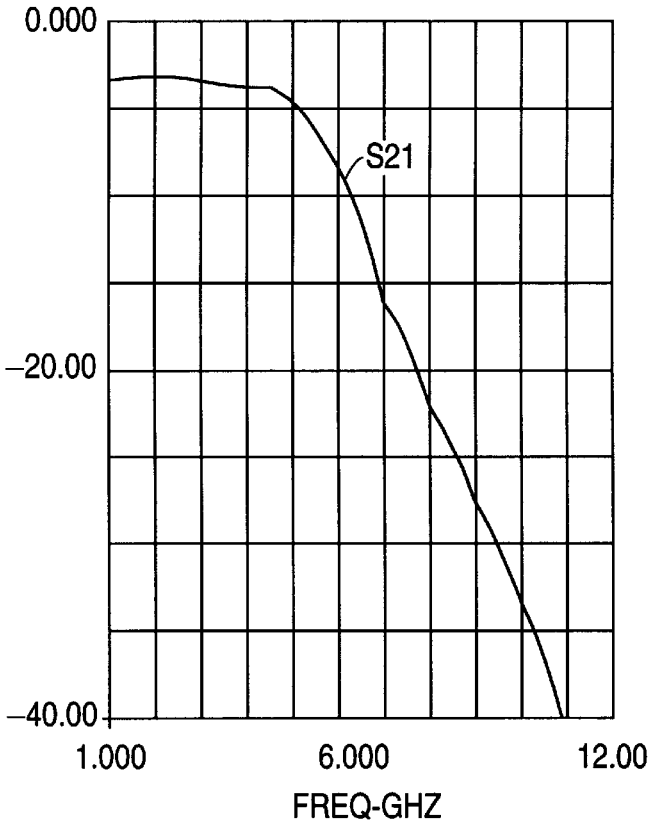
FIG. 5 is a graph showing the insertion loss characteristic of the power divider of FIG. 2.
Figure 6:
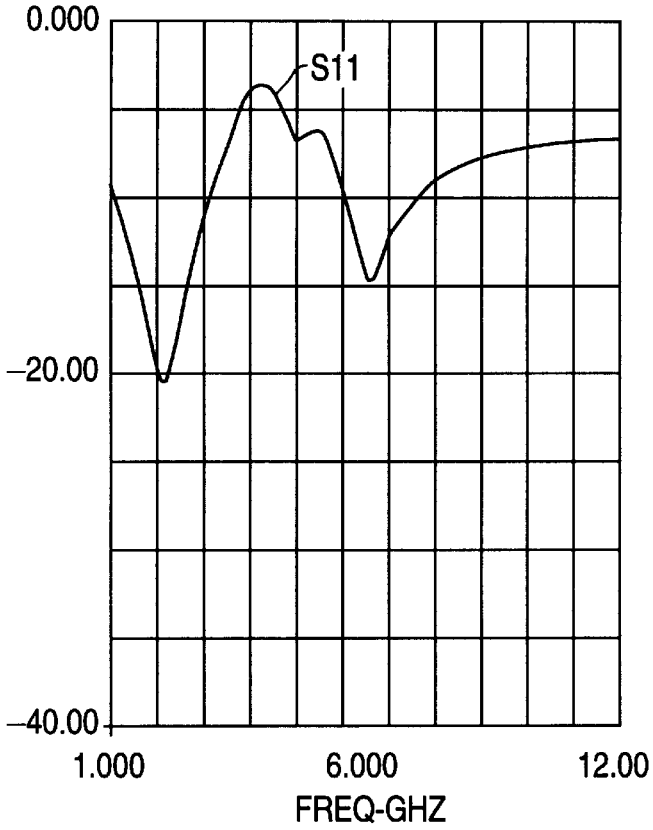
FIG. 6 is a graph showing the input return loss characteristic of the power divider of FIG. 2.
Figure 7:
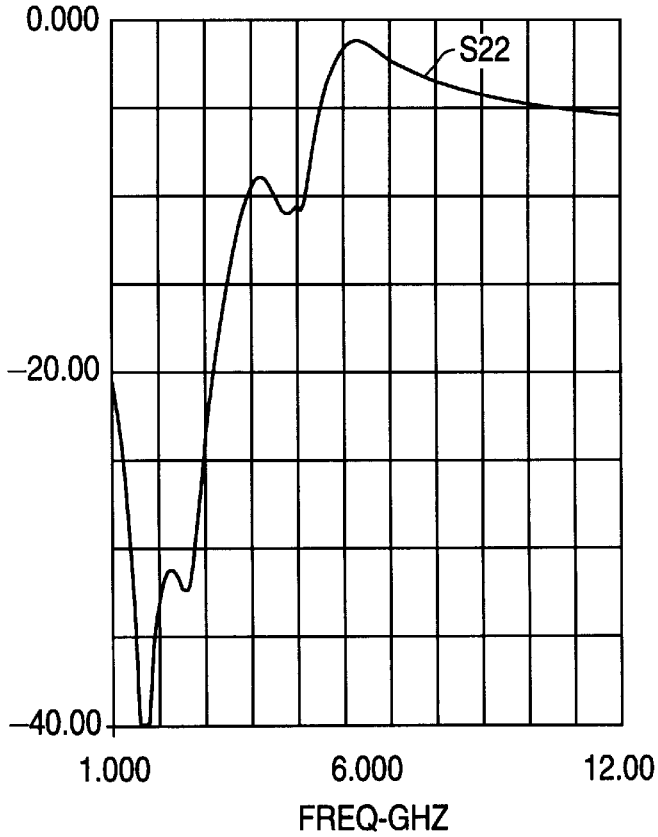
FIG. 7 is a graph showing the output return loss characteristic of the power divider of FIG. 2.
Figure 8:
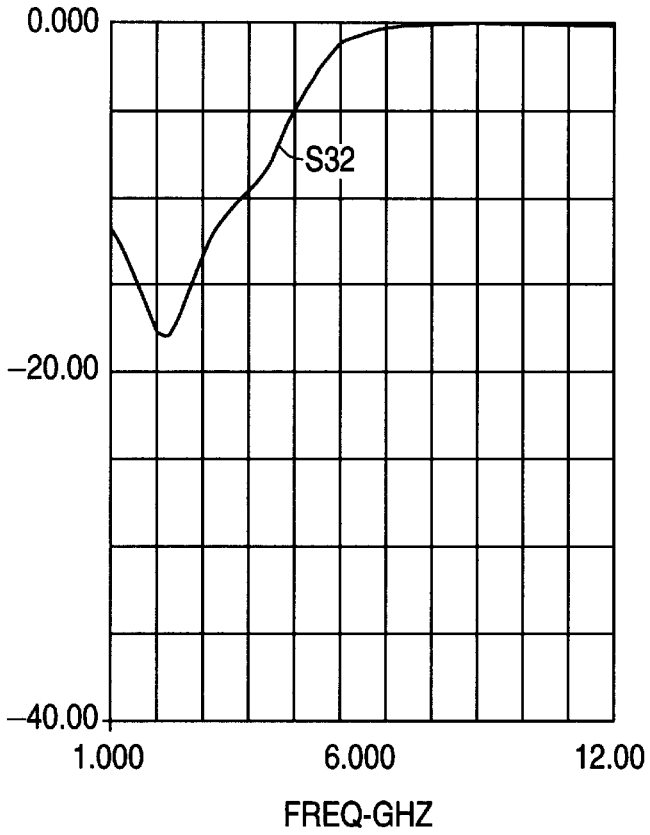
FIG. 8 is a graph showing the isolation characteristic of the power divider of FIG. 2.

FIGS. 4 8 illustrate the operational characteristics of power divider 20. In the present embodiment, power divider 20 is designed as a 2 GHz power divider with a desired frequency operation range of 2 to 2.5 GHz. However, this is illustrative only and one skilled in the art will appreciate that power divider 20 can be designed to operate at any frequency within the radio frequency range or microwave frequency range.

The Smith Chart of FIG. 4 illustrates the impedance transformation of first and second transformers 24, 25 from 50 ohms to 100 ohms at 2 GHz. Curve 42 maps the impedance transformation from 50 ohms at output ports 27 and 28 (point 44) to 100 ohms at input port 22 (point 46). Note that the impedance of transformers 24, 25 are each 100 ohms at the point the transformers converge at input port 22. Because transformers 24 and 25 are connected in parallel, only a 50 ohms impedance is seen by input port 22.

FIGS. 5–8 illustrate the simulated performance characteristics of power divider 20. In FIGS. 5–8, the abscissa axis is frequencies in the range of 1 GHz to 12 GHz. The ordinate axis is the amounts of attenuation in units of decibels (dB) from 0 dB to −40 dB. Curve S21 (FIG. 5) illustrates the insertion loss characteristic of power divider 20 (i.e. the loss at each of output ports 27 and 28). Power divider 20 behaves as a power divider at the low frequency range of 1 to 4 GHz while providing a low pass filter response at high frequencies. At 2 GHz, curve S21 shows that the output signal at each of output ports 27, 28 has a −3 dB attenuation. Power divider 20 has a corner frequency at approximately 5 GHz and rejects the 5th harmonic of 2 GHz (10 GHz) by over −30 dB. Thus, power divider 20 exhibits excellent low pass filter characteristics.

Curve S11 (FIG. 6) illustrates the input return loss characteristic (or input reflection characteristic) of power divider 20 at input port 22.

Curve S11 shows that the reflection at input port 22 is reduced to −20 dB at 2 GHz for input signals at input port 22. Curve S22 (FIG. 7) illustrates the output return loss characteristic of power divider 20 at each of output ports 27 and 28. Curve S22 shows that the reflection at output ports 27 and 28 is reduced to greater than −30 dB at 2 GHz for input signals at output ports 27, 28. Therefore, power divider 20 can function satisfactorily as a power combiner as well in the 2–2.5 GHz frequency range.

Curve S32 (FIG. 8) illustrates the isolation characteristic of power divider 20. At 2 GHz, any signal leaking between output ports 27 and 28 is attenuated by approximately −18 dB. Thus, power divider 20 exhibits good isolation characteristics.

Figure 1:
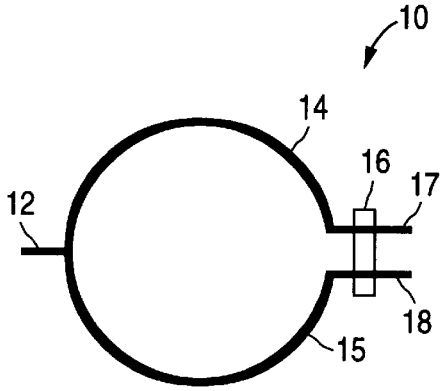
FIGURE 1 (PRIOR ART)
FIG. 1 is a top view of a conventional power divider.

Power divider 20 achieves significant size reduction over conventional power dividers, such as the Wilkinson power divider in FIG. 1. Power divider 20 has a peripheral length from input port 22 to output port 27 or 28 of only 0.16λ. (The peripheral length is given by the sum of series transmission line elements 24*a–c*.) The 0.16λ peripheral length represents a significant reduction over a conventional power divider which has a peripheral length of 0.25λ. Therefore, power divider 20 achieves a size reduction of up to 35% over conventional power dividers. Furthermore, power divider 20 incorporates a low pass filter structure, thus eliminating the need to use an external low pass filter in series with the power divider. The overall size of the microwave circuit is significantly reduced.

In the present embodiment, power divider 20 further includes a ground plate 23. Ground plate 23 is floating, i.e., it is not directly connected to any electrical potential. Rather, ground plate 23 is capacitively coupled to the open ends of shunt transmission line elements 24*d–e* and 25*d–e* through the substrate of power divider 20. In operation, because shunt transmission line elements 24*d* and 25*d* are at the same potential and shunt transmission line elements 24*e* and 25*e* are at the same potential, capacitive coupling between these electrical nodes of equal potential and ground plate 23 forces the floating ground plate to a virtual ground potential.

In the present embodiment, a floating ground plate is used to facilitate a compact physical layout for power divider 20. Ground plate 23 is placed in the center of the rectangularly shaped first and second transformers 24, 25. However, in an alternate embodiment, instead of being floating, ground plate 23 can be electrically connected to the ground potential using means known in the art. For example, ground plate 23 can made contact with a ground node through an opening in the substrate of power divider 20 underneath ground plate 23.

Adding ground plate 23 to capacitively couple the shunt transmission line elements of power divider 20 has the effect of enhancing the low pass rejection properties of power divider 20. When ground plate 23 is added, the corner frequency of the low pass filter structure of power divider 20 is reduced so that rejection of high frequency harmonics is improved.

Figure 10:
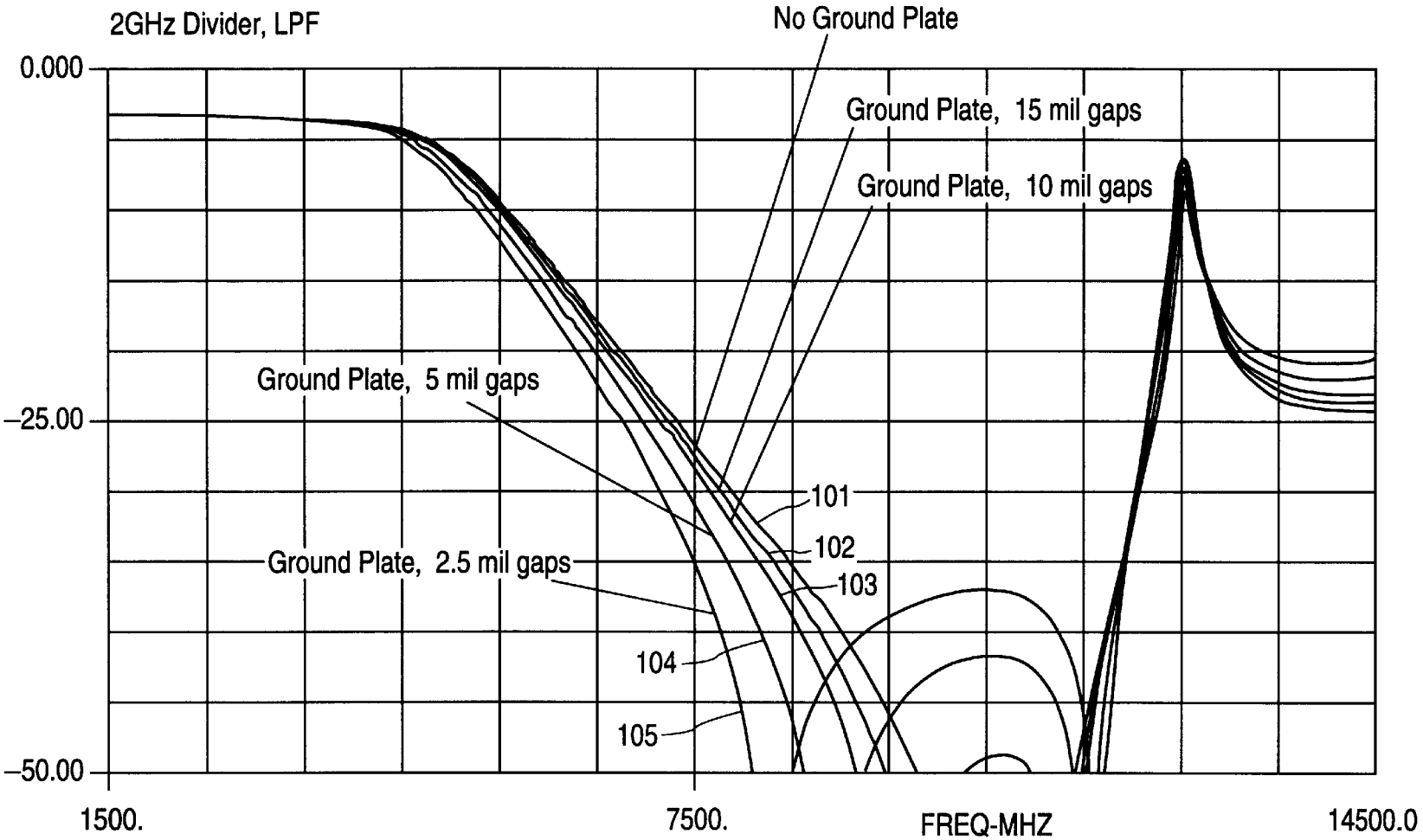
FIG. 10 is a graph showing the insertion loss characteristics of the power divider of FIG. 2 with decreasing gap widths between the low pass filter structure and the ground plate.

The corner frequency of power divider 20 can be tailored by increasing the capacitance of the coupling capacitors formed between each of shunt transmission line elements 24*d–e*, 25*d–e* and ground plate 23. The capacitance of the coupling capacitors in power divider 20 is given by:

$$C = \frac{\varepsilon A}{d}$$

where ε is the dielectric constant of the substrate of power divider 20, A is the area of the electrodes forming the coupling capacitors, and d is the distance between the two plates of the electrodes (i.e., the distance between the shunt transmission line elements and ground plate 23). As seen from the above equation, the capacitance of the coupling capacitors can be increased by decreasing the distance d (or the gap width) between ground plate 23 and each of shunt transmission line elements 24*d–e*, 25*d–e*. FIG. 10 is a plot illustrating the insertion loss characteristics of a 2 GHz power divider with respect to decreasing gap widths between ground plate 23 and shunt transmission line elements 24*d–e*, 25*d–e*. Curve 101 illustrates the low pass frequency response of the power divider when no ground plate is included. As shown, when no ground plate is used, the power divider has an attenuation of −30 dB at approximately 8 GHz. The remaining curves 102–105 illustrate that when a ground plate is included, the low pass rejection characteristics are improved. Specifically, when a gap width of only 2.5 mils is used (curve 105), the power divider has a −30 dB attenuation at approximately 7 GHz. Therefore, FIG. 10 illustrates that when ground plate 23 is included in power divider 20 with a narrow gap width, the capacitive coupling effect of ground plate 23 is enhanced to further improve the low pass filter response of power divider 20.

The capacitance of the coupling capacitors can also be increased by increasing the area (A) of the capacitors. In power divider 20, shunt transmission line elements 24*d–e*, 25*d–e* are shaped as trapezoids. The width at the open ends of shunt transmission line elements 24*d–e*, 25*d–e* is wider than the ends abutting the series transmission line elements. The wider areas at the open ends of shunt transmission line elements 24*d–e*, 25*d–e* have the effect of increasing the area A of the coupling capacitors, thus, increasing the capacitance of the coupling capacitors. The trapezoidal shaped shunt line elements 24*d–e* and 25*d–e* used in power divider 20 further improves the effectiveness of the capacitive coupling between ground plate 23 and shunt transmission line elements 24*d–e* and 25*d–e*.

When power divider 20 is constructed on a printed circuit board substrate such as the Rogers™ 4003 copper clad laminate, the dielectric constant of the substrate is 3.38 which is sufficient to provide a desirable capacitive coupling between ground plate 23 and shunt transmission line elements 24*d–e*, 25*d–e*. However, when the power divider of the present invention is constructed on a GaAs substrate as a MMIC device, the low pass filter characteristics of the power divider is improved significantly because the dielectric constant of GaAs is 13, much larger than the dielectric constant of the printed circuit board substrate.

In FIG. 2, first and second transformers 24, 25 are shaped as a rectangle. The rectangular shape of power divider 20 is illustrative only and is not intended to limit the present invention to a power divider having a rectangular structure. The use of the rectangular shaped transformers in power divider 20 has the advantage of providing symmetry and allowing the placement of ground plate 23 within the rectangle to realize a compact power divider design.

However, other shapes may be used, such as an arc, to form the transformers in power divider 20 as long as the total length of the transmission line elements (series and shunt) is a quarter-wavelength ($\lambda/4$). Moreover, one skilled in the art will appreciate that a power divider according to the present invention can employ transformers having a total length of $\lambda/4$ or any odd integer multiple of $\lambda/4$, such as $3\lambda/4$, $5\lambda/4$ or $7\lambda/4$.

Figure 3:
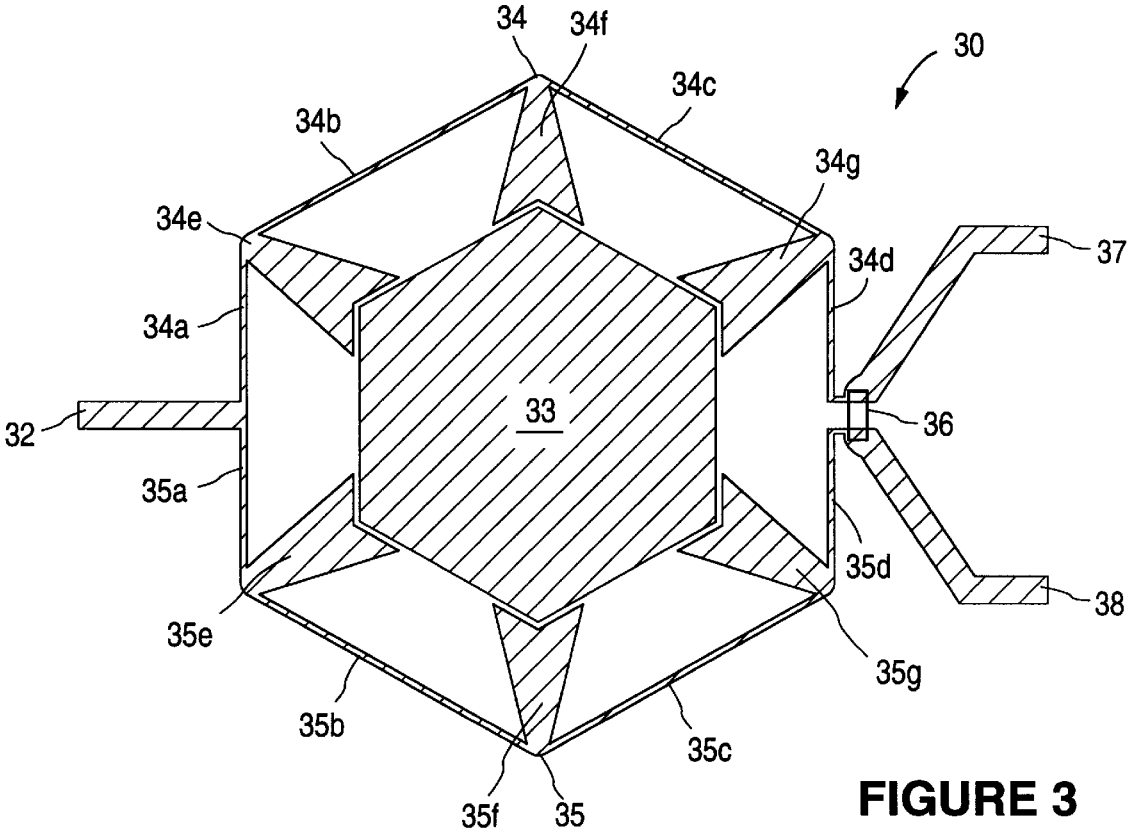
FIG. 3 is a top view of a power divider according to another embodiment of the present invention.

FIG. 3 illustrates a power divider 30 according to another embodiment of the present invention. Power divider 30 includes four series transmission line elements and three shunt transmission line elements in each of first and second transformers 34 and 35. Power divider 30 is provided with an additional filter section to further reduce the corner frequency of the low pass filter structure. Power divider 30 assumes a hexagonal structure with symmetrical first and second transformers 34 and 35.

Series transmission line elements 34*a–d,* 35*a–d* of power divider 30 are each a 115 ohms transmission line. Shunt transmission line elements 34*e–g,* 35*e–g* are each a 40 ohms transmission line. Transformers 34 and 35 of power divider 30 are each a quarter-wavelength transformer. However, in order to accommodate the additional filter section, the total length of each of transformers 34 and 35 is set to $3\lambda/4$ (or $0.75\lambda$). With respect to first transformer 34, series transmission line elements 34*a* and 34*d,* and shunt transmission line elements 34*e–g* are each $0.083\lambda$ in length. Series transmission line elements 34*b–c* are each $0.166\lambda$ in length, yielding a total length of $0.75\lambda$. Second transformer 35 has an identical structure as that of first transformer 34 and the lengths of transmission line elements 35*a–g* is the same as their respective elements in first transformer 34.

Power divider 30 includes a ground plate 33 which assumes a hexagonal shape and occupies a larger area than ground plate 23 of power divider 20. The larger area of ground plate 33 improves the capacitive coupling of ground plate 33 to shunt transmission line elements 34*e–g,* 35*e–g*. Furthermore, the open ends of shunt transmission line elements 34*e–g,* 35*e–g* are elongated and configured to align with the corners of ground plate 33, further increasing the area available for capacitive coupling with ground plate 33.

Figure 9:
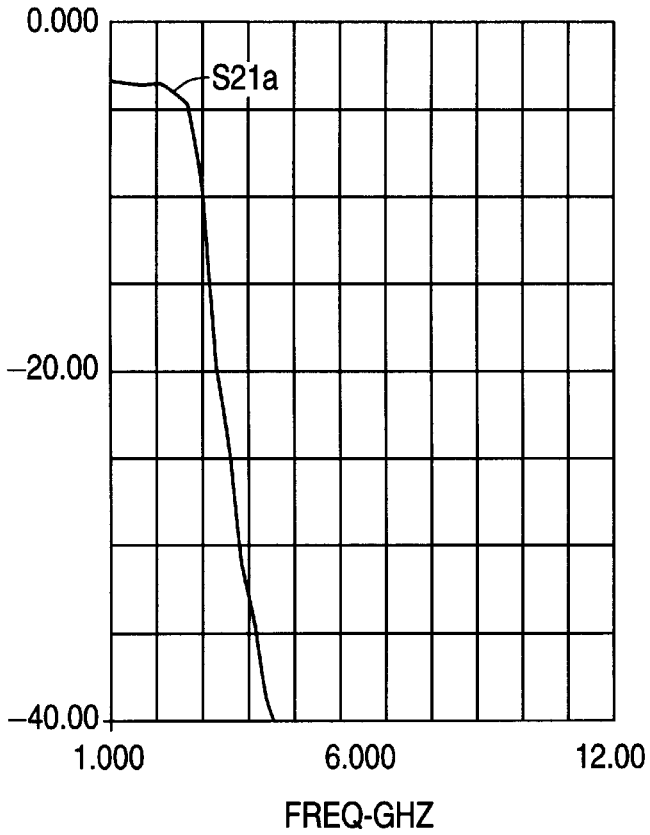
FIG. 9 is a graph showing the insertion loss characteristic of the power divider of FIG. 3.

Curve S21*a* (FIG. 9) illustrates the insertion loss characteristic of power divider 30. The corner frequency of power divider 30 occurs at approximately 2.5 GHz while power divider 30 achieves a greater than −30 dB attenuation at 4 GHz (as compared to 10 GHz in power divider 20). Power divider 30 is useful when a narrow band power divider is desired.

The peripheral length of each of the first and second transformers of power divider 30 is $0.5\lambda$. The improvement in low pass rejection characteristics of power divider 30 comes at the expense of a larger device size. However, because power divider 30 incorporates a low pass filter structure, the size of power divider 30 is still smaller than the size of a conventional microwave circuit including a conventional power divider connected in series with a low pass filter. As it will be appreciated by one skilled in the art, the improved low pass filtering characteristic is also obtained at the expense of narrowing the bandwidth of operation, also called the pass band of the power divider. For power divider 20, the achievable bandwidth is approximately 20%. Therefore, at a 2 GHz operating frequency, the pass band is between 1.6 GHz and 2.4 GHz. For power divider 30, the achievable bandwidth is only approximately 10%. Thus, at a 2 GHz operating frequency, the pass band is limited to 1.8 GHz to 2.2 GHz.

The above detailed description is provided to illustrate the specific embodiments of the present invention and is not intended to be limiting. Numerous modifications and variations within the scope of the present invention are possible. For example, the ground plate of the power divider of the present invention can assume any suitable shapes as long as the ground plate is capacitively coupled to the shunt transmission line elements. Furthermore, the two-way power divider of the present invention can be cascaded in a manner known in the art to form an N-way power divider. The present invention is defined by the appended claims thereto.

We claim:

1. A power divider/combiner for dividing and combining microwave power, comprising:

an input port;

a first output port;

a second output port;

a first transformer coupled between said input port and said first output port;

a second transformer coupled between said input port and said second output port;

said first and second transformers each including a low pass filter; and a ground plate disposed coplanar with the low pass filters and adjacent to said first and second transformers, said ground plate being capacitively coupled to said low pass filters of said first and second transformers.

2. The power divider/combiner of claim 1, wherein said first and second transformers each comprises:

a plurality of series transmission line elements, said series transmission line elements connected in series along said respective one of said transformers; and a plurality of shunt transmission line elements, said shunt transmission line elements extending from said series transmission line elements towards said ground plate;

wherein said ground plate is capacitively coupled to said plurality of shunt transmission line elements.

3. The power divider/combiner of claim 2, wherein said plurality of series transmission line elements comprise high impedance transmission line elements.

4. The power divider/combiner of claim 2, wherein a first one of said series transmission line elements has a length different from a second one of said series transmission line elements and the sum of the lengths of said plurality of series transmission line elements and shunt transmission line elements equals an odd integer multiple of a quarter wavelength.

5. The power divider/combiner of claim 2, wherein said plurality of shunt transmission line elements comprise low impedance transmission line elements.

6. The power divider/combiner of claim 2, wherein each of said plurality of shunt transmission line elements has a first width at an end abutting said series transmission line elements and a second width at an end capacitively coupled to said ground plate, said second width being wider than said first width.

7. The power divider/combiner of claim 6, wherein each of said plurality of shunt transmission line elements has a trapezoidal shape.

8. The power divider/combiner of claim 1, further comprises a resistor disposed between said first output port and said second output port, said resistor providing isolation for said first and second output ports.

9. The power divider/combiner of claim 1, wherein said power divider/combiner is constructed on a printed circuit board comprising microwave laminate.

10. The power divider/combiner of claim 1, wherein said power divider/combiner is constructed as a monolithic microwave integrated circuit.

11. The power divider/combiner of claim 1, wherein said ground plate is floating.

12. The power divider/combiner of claim 11, wherein said ground plate is at a virtual ground potential.

13. The power divider/combiner of claim 1, wherein said ground plate is electrically coupled to a ground node.

14. The power divider/combiner of claim 1, wherein said ground plate occupies substantially all of the area between said first and second transformers.

15. A power divider/combiner for dividing and combining microwave power, comprising:

an input port;

a first output port;

a second output port;

a first transformer coupled between said input port and said first output port, said first transformer including a low pass filter; and a second transformer coupled between said input port and said second output port, said second transformer including a low pass filter;

wherein each of said first and second transformers comprises a plurality of series transmission line elements and a plurality of shunt transmission line elements, said plurality of series transmission line elements are of different lengths and a sum of the lengths of said plurality of series and shunt transmission line elements equals an odd integer multiple of a quarter wavelength.

16. The power divider/combiner of claim 15, wherein said plurality of series transmission line elements comprise high impedance transmission line elements.

17. The power divider/combiner of claim 15, wherein said plurality of shunt transmission line elements comprise low impedance transmission line elements.

18. The power divider/combiner of claim 15, wherein each of said plurality of shunt transmission line elements has a first width at a first end abutting said series transmission line elements and a second width at a second end opposite said first end, said second width being wider than said first width.

19. The power divider/combiner of claim 18, wherein each of said plurality of shunt transmission line elements has a trapezoidal shape.

20. The power divider/combiner of claim 15, further comprises a resistor disposed between said first output port and said second output port, said resistor providing isolation for said first and second output ports.

21. The power divider/combiner of claim 15, further comprising a ground plate disposed adjacent to said first and second transformers, said ground plate being capacitively coupled to said low pass filters of said first and second transformers.

22. The power divider/combiner of claim 21, wherein said ground plate occupies substantially all of the area between said first and second transformers.

23. The power divider/combiner of claim 21, wherein said ground plate is floating.

24. The power divider/combiner of claim 21, wherein said ground plate is electrically coupled to a ground node.

25. The power divider/combiner of claim 15, wherein said power divider/combiner is constructed on a printed circuit board comprising microwave laminate.

26. The power divider/combiner of claim 15, wherein said power divider/combiner is constructed as an monolithic microwave integrated circuit.

27. A power divider/combiner for dividing and combining microwave power, comprising:

an input port;

a first output port;

a second output port;

a first transformer coupled between said input port and said first output port, a second transformer coupled between said input port and said second output port;

said first and second transformers each comprising a first, second and third series transmission line elements, and a first and second shunt transmission line elements, said series and shunt transmission line elements functioning as a low pass filter;

wherein said first and second transformers are disposed in a rectangular configuration, and a sum of the lengths of said series and shunt transmission line elements for each of said first and second transformers equals a quarter wavelength.

28. The power divider/combiner of claim 27, further comprises a resistor disposed between said first output port and said second output port, said resistor providing isolation for said first and second output ports.

29. The power divider/combiner of claim 27, further comprising a ground plate disposed between said first and second transformers, said ground plate being capacitively coupled to said shunt transmission line elements of said first and second transformers.

30. The power divider/combiner of claim 29, wherein said ground plate is floating.

31. The power divider/combiner of claim 29, wherein said ground plate has a rectangular shape.

32. A power divider/combiner for dividing and combining microwave power, comprising:

an input port;

a first output port;

a second output port;

a first transformer coupled between said input port and said first output port, a second transformer coupled between said input port and said second output port;

said first and second transformers each comprising a first, second, third, and fourth series transmission line elements, and a first, second, and third shunt transmission line elements, said series and shunt transmission line elements functioning as a low pass filter;

wherein said first and second transformers are disposed in a hexagonal configuration, and a sum of the lengths of said series and shunt transmission line elements for each of said first and second transformers equals an odd integer multiple of a quarter wavelength.

33. The power divider/combiner of claim 32, further comprises a resistor disposed between said first output port and said second output port, said resistor providing isolation for said first and second output ports.

34. The power divider/combiner of claim 32, further comprising a ground plate disposed between said first and second transformers, said ground plate being capacitively coupled to said shunt transmission line elements of said first and second transformers.

35. The power divider/combiner of claim 34, wherein said ground plate is floating.

36. The power divider/combiner of claim 34, wherein said ground plate has a hexagonal shape.

* * * * *